US012774872B2

(12) United States Patent
Zhao

(10) Patent No.: US 12,774,872 B2
(45) Date of Patent: Oct. 27, 2026

(54) EXTENSION ADAPTER AND SHOOTING ASSEMBLY

(71) Applicant: ACRONIX INC, Cheyenne, WY (US)

(72) Inventor: Yingchun Zhao, Qingdao City (CN)

(73) Assignee: ACRONIX INC, Cheyenne, WY (US)

( * ) Notice: Subject to any disclaimer, the term of this patent is extended or adjusted under 35 U.S.C. 154(b) by 0 days.

(21) Appl. No.: 19/280,403

(22) Filed: Jul. 25, 2025

(65) Prior Publication Data

US 2026/0194331 A1 Jul. 9, 2026

(30) Foreign Application Priority Data

Jan. 9, 2025 (CN) ..... 202520052419.5

(51) Int. Cl.
*F41J 1/10* (2006.01)

(52) U.S. Cl.
CPC ..... *F41J 1/10* (2013.01)

(58) Field of Classification Search
CPC .... F41J 1/10; F41J 3/0004; F41J 13/00; F41J 1/00; F41J 11/00
See application file for complete search history.

(56) References Cited

U.S. PATENT DOCUMENTS 4,739,996 A * 4/1988 Vedder ..... F41J 7/04 273/392
4,949,980 A * 8/1990 Hoy ..... F41J 7/04 273/391
4,979,752 A * 12/1990 Fosseen ..... F41J 7/04 273/392
5,240,258 A * 8/1993 Bateman ..... F41J 1/10 273/392
5,288,275 A * 2/1994 St. Peter ..... A63D 3/00 273/127 D
5,598,996 A * 2/1997 Rath ..... F41J 1/10 248/163.1
7,219,897 B2 * 5/2007 Sovine ..... F41J 7/06 273/390
7,338,048 B1 * 3/2008 Hulstine ..... F41J 1/10 211/196
7,644,927 B2 * 1/2010 Law ..... F41J 1/10 40/607.1
7,845,646 B1 * 12/2010 Weber ..... F41J 1/01 273/407

(Continued)

FOREIGN PATENT DOCUMENTS

CN 202011494553 A * 12/2020 ..... F41J 1/10

*Primary Examiner* — John E Simms, Jr.
*Assistant Examiner* — Amir A Klayman
(74) *Attorney, Agent, or Firm* — Yong Chen

(57) ABSTRACT

Disclosed is an extension adapter and a shooting assembly. The extension adapter is configured for mounting a target on a target stand. The extension adapter comprises a connecting member and a target mounting seat interconnected with each other. The connecting member is configured for detachably connecting to the target stand, or being welded to the target stand, or being integrally formed with the target stand. The target mounting seat is configured for mounting the target; the shooting assembly comprises the aforementioned target stand. The present application solves the problems of poor adaptability and mounting stability between targets and target stand products having different sizes and specifications.

20 Claims, 19 Drawing Sheets

(56) References Cited

U.S. PATENT DOCUMENTS 8,844,934 B2 * 9/2014 Dean ..... F41J 1/10 273/380
9,163,912 B1 * 10/2015 Stark ..... F41J 7/04
9,267,769 B1 * 2/2016 Gempler ..... B25H 1/06
9,631,905 B2 * 4/2017 Doria ..... F41J 1/10
9,702,667 B1 * 7/2017 Gutierrez ..... F41J 9/02
10,001,349 B2 * 6/2018 Côté ..... F41J 7/04
10,066,907 B2 * 9/2018 Pixton ..... F41J 1/10
10,088,279 B2 * 10/2018 Hoy, Jr. ..... F41J 5/18
10,139,203 B1 * 11/2018 Teal ..... F41J 1/10
10,253,923 B2 * 4/2019 Heckler ..... F16M 11/22
10,401,131 B1 * 9/2019 Remaklus ..... F41J 1/10
11,466,968 B1 * 10/2022 Garstka ..... F41J 7/04
12,292,265 B2 * 5/2025 Ji ..... F41J 1/10
2006/0125185 A1 * 6/2006 Rolfe ..... F41J 7/04 273/390
2007/0114724 A1 * 5/2007 Bassett ..... F41J 11/00 244/3.1
2008/0023915 A1 * 1/2008 Morrow ..... F41J 1/10 273/366
2008/0174071 A1 * 7/2008 Potterfield ..... F41J 9/02 273/366
2008/0272548 A1 * 11/2008 Hensley ..... F41J 7/00 273/406
2009/0256314 A1 * 10/2009 Kobett ..... F41J 1/10 273/407
2011/0163503 A1 * 7/2011 Townsend ..... F41J 7/04 273/355
2015/0330748 A1 * 11/2015 Anzalone ..... F41J 1/10 273/390
2016/0290552 A1 * 10/2016 Holestine ..... F16M 11/046
2016/0370153 A1 * 12/2016 Côté ..... F41J 1/10
2018/0087880 A1 * 3/2018 Fernandez ..... F41J 7/04
2019/0025016 A1 * 1/2019 Schroedel ..... F41J 1/10
2022/0252379 A1 * 8/2022 Leenheer ..... F41J 1/10
2022/0390212 A1 * 12/2022 Zhao ..... F41J 1/10

* cited by examiner

EXTENSION ADAPTER AND SHOOTING ASSEMBLY

CROSS-REFERENCE TO RELATED APPLICATION

The present application claims priority to Chinese Patent Application No. 202520052419.5, filed with the China National Intellectual Property Administration (CNIPA) on Jan. 9, 2025, which is hereby incorporated by reference in its entirety.

TECHNICAL FIELD

The present application relates to the field of shooting props, and more particularly, to an extension adapter and a shooting assembly.

BACKGROUND ART

Existing targets and target stands have poor mounting stability, and the adaptability between targets and target stands produced by different manufacturers, having different sizes and specifications, still needs improvement.

Therefore, it is necessary to provide a shooting prop that can improve the adaptability and mounting stability between targets and target stands having different sizes and specifications.

SUMMARY

The purpose of the present application is to provide an extension adapter and a shooting assembly to solve the problems of poor adaptability and mounting stability between targets and target stands having different sizes and specifications.

To achieve the above purpose, the present application provides the following technical solution:

An extension adapter for mounting a target on a target stand, wherein the extension adapter comprises a connecting member and a target mounting seat interconnected with each other, wherein the connecting member is configured to be detachably connected to the target stand, and the target mounting seat is configured to mount the target, or be welded to the target stand, or be integrally formed with the target stand.

In some embodiments of the present application, the connecting member and the target mounting seat are integrally designed;

or, the connecting member and the target mounting seat are separately designed.

In some embodiments of the present application, the connecting member is provided with a magnetic attraction member, wherein the connecting member is capable of being fixed on the target stand via the magnetic attraction member;

and/or, the target mounting seat is provided with a magnetic attraction member, wherein the target mounting seat is capable of fixing the target thereto via the magnetic attraction member.

In some embodiments of the present application, the connecting member is columnar and capable of being inserted into the target stand.

In some embodiments of the present application, the connecting member is semi-enclosedly sleeved on the target stand;

or, the connecting member is fully enclosedly sleeved on the target stand.

In some embodiments of the present application, the connecting member has a first support portion, a second support portion, and a third support portion connected in sequence. The first support portion and the third support portion are arranged parallel to each other, and the first support portion and the third support portion are each provided with a first through hole.

The extension adapter further comprises a first fastener, wherein the first fastener sequentially passes through the first through holes of the first support portion and the third support portion, wherein the first fastener can pass through or not pass through the target stand, so that the first support portion and the third support portion clamp the target stand, thereby fixing the extension adapter to the target stand.

In some embodiments of the present application, the first through hole in the first support portion and the first through hole in the third support portion are arranged directly opposite to each other, wherein the first fastener is capable of sequentially passing through the first through hole in the first support portion, the target stand, and the first through hole in the third support portion.

In some embodiments of the present application, at least one of the first support portion, the second support portion, and the third support portion is plate-shaped.

In some embodiments of the present application, the first support portion and the third support portion are flat plate-shaped;

and/or, the second support portion is flat plate-shaped or curved plate-shaped.

In some embodiments of the present application, the target mounting seat is provided with a second through hole;

wherein, a bottom of the target is capable of being inserted into or screwed into the second through hole to be fixed on the extension adapter;

and/or, the extension adapter further comprises a second fastener, wherein the second fastener passes through the second through hole, wherein the target is capable of being fixed on the extension adapter via the second fastener.

In some embodiments of the present application, the shape of the second through hole is any one of circular, rectangular, L-shaped, triangular, elliptical, polygonal, and star-shaped.

In some embodiments of the present application, the target mounting seat comprises a first part and a second part arranged parallel to each other, wherein at least one of the first part and the second part is provided with the second through hole to fix the target;

wherein, the target is L-shaped, wherein a bottom of the L-shaped target abuts against any one of the first part and the second part, wherein the target is fixed on the target mounting seat by the second fastener;

or, the target is capable of sequentially passing through the first part and the second part.

In some embodiments of the present application, the second through holes of the same shape in the first part and the second part are arranged directly opposite to each other, wherein the second fastener is capable of sequentially passing through the second through hole in the first part of the target mounting seat, the bottom of the target, and the second through hole in the second part.

In some embodiments of the present application, the target mounting seat further comprises a third part and a third fastener, wherein the third part is connected perpendicularly to at least one of the first part and the second part, wherein the third part is provided with a third through hole;

wherein the third fastener is capable of passing through the third through hole to abut against the bottom of the target, so that the target is fixed to the target mounting seat, or, the third fastener is capable of sequentially passing through the third through hole and the bottom of the target, so that the target is fixed to the target mounting seat.

In some embodiments of the present application, an inner wall surface of the third through hole is provided with a thread, wherein the third fastener is provided with a thread;

or, the third fastener is a bolt, wherein at least one side of the second through hole close to or away from a head of the bolt is fixedly provided with a nut connecting therewith.

In some embodiments of the present application, at least one of the first part, the second part, and the third part of the target mounting seat is plate-shaped.

In some embodiments of the present application, a depth direction of the second through hole is configured to be the same as a vertical direction, or the same as a horizontal direction;

and/or, the extension adapter further comprises a boss, wherein the boss is provided on at least one of the first part and the second part of the target mounting seat, wherein the boss is provided with an insertion hole, wherein an orientation of the insertion hole is configured to be the same as the vertical direction, or the same as the horizontal direction, wherein the target is capable of being inserted into the insertion hole.

In some embodiments of the present application, the extension adapter further comprises a bracket, wherein the bracket has at least two legs, wherein each leg of the bracket is inserted into a second through hole, wherein the bracket is configured to suspend the target.

To achieve the above purpose, the present application further provides the following technical solution:

A shooting assembly, wherein the shooting assembly comprises:

a target stand;

the aforementioned extension adapter, wherein the extension adapter is detachably mounted on the target stand, or welded to the target stand, or integrally formed with the target stand.

In some embodiments of the present application, the shooting assembly further comprises a target, wherein, the target is inserted into the second through hole of the extension adapter;

or, the target is suspended or inserted in the bracket of the extension adapter, wherein the number of the extension adapters is at least two, wherein the bracket has at least two legs, wherein each leg is respectively inserted into a second through hole of one of the extension adapters;

or, a bottom of the target is provided with a fourth through hole, wherein the fourth through hole and the second through hole of the extension adapter are arranged directly opposite to each other, wherein the second fastener passes through the fourth through hole and the second through hole, so that the target and the extension adapter are fixed to each other.

In some embodiments of the present application, the target comprises a target surface and a base detachably connected to each other, wherein the target surface is configured for shooting, wherein the base is connected to the extension adapter.

In some embodiments of the present application, the target surface and the base are fastened together by screws.

In some embodiments of the present application, the target surface and the base are connected by a pin shaft and a spring, wherein when the target surface is knocked down, the spring can reset the target surface.

In some embodiments of the present application, the target stand is provided with a target stand through hole, wherein, the first fastener of the extension adapter passes through the first through hole of the extension adapter and the target stand through hole, so that the extension adapter is detachably mounted on the target stand;

or, the target comprises a target surface and a suspension chain detachably connected to each other, wherein the target surface is configured for shooting, wherein the suspension chain is suspended on the target stand via the target stand through hole.

In some embodiments of the present application, the target stand comprises support legs and a crossbar interconnected with each other, wherein the connecting member of the extension adapter is mounted on the crossbar.

In some embodiments of the present application, the crossbar is a telescopic crossbar, wherein the telescopic crossbar comprises a main body and an extension rod movably connected to each other, wherein the main body is a hollow long rod, wherein the extension rod can be accommodated in an inner cavity of the main body and can also be pulled out from the inner cavity of the main body to extend the length of the telescopic crossbar, wherein both the main body and the extension rod are provided with the target stand through hole.

Other applicable fields will become apparent from the description provided in this disclosure.

The descriptions and specific examples in the present application are intended for illustration only and are not intended to limit the scope of the present disclosure.

Compared with the prior art, the technical solutions according to the present application achieve the following beneficial effects:

1. The extension adapter according to the present application can stably fix the target on the target stand.
2. The extension adapter according to the present application can be used individually or multiple extension adapters can be combined for use on the target stand to adapt to different target products.
3. The extension adapter according to the present application is provided with holes of different shapes to adapt to different target products.

BRIEF DESCRIPTION OF THE DRAWINGS

To more clearly illustrate the technical solutions in the embodiments of the present application, a brief introduction to the drawings required for the description of the embodiments will be given below. It is apparent that the drawings in the following description are merely some embodiments of the present application, and for those skilled in the art, other drawings can be obtained based on these drawings without creative efforts.

DETAILED DESCRIPTION OF EMBODIMENTS

Figure 1:
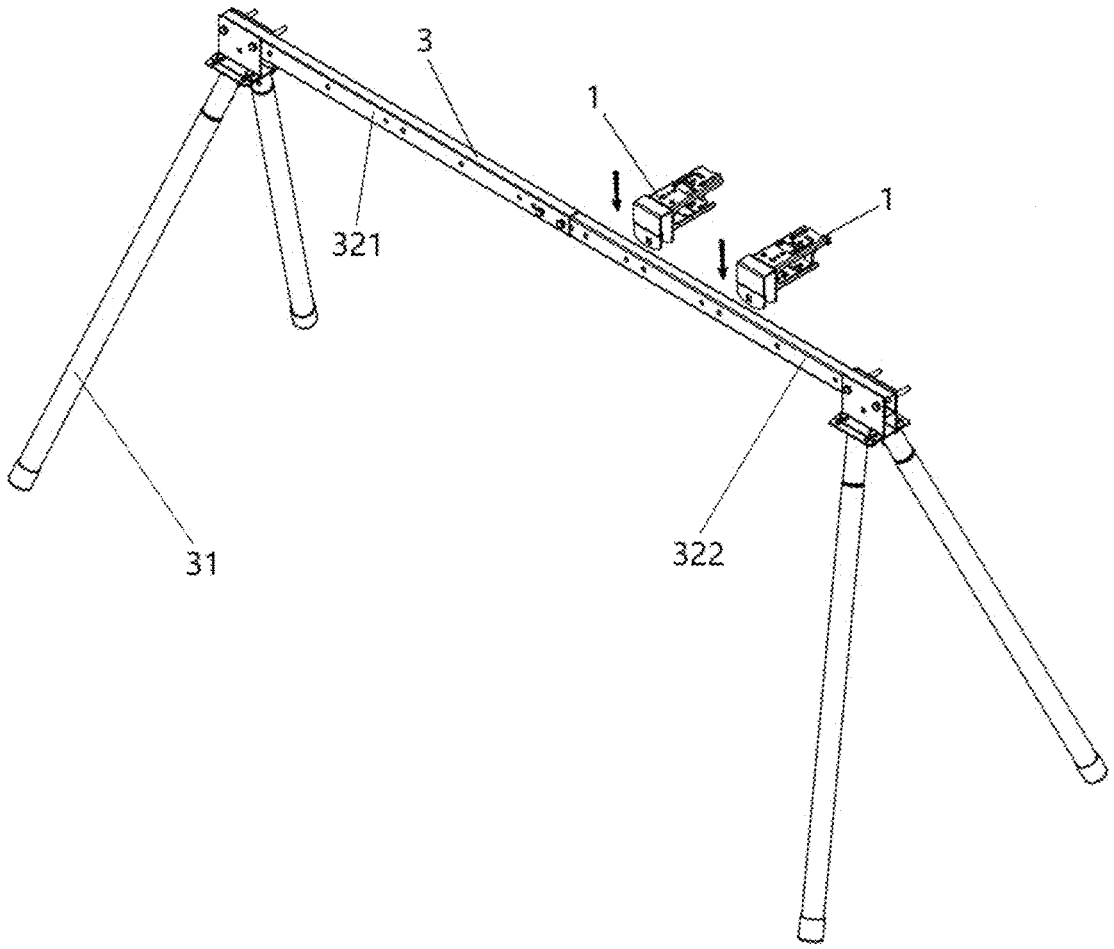
FIG. 1 is a schematic structural diagram of an extension adapter and a target stand according to a first embodiment of the present application.

The technical solutions in the embodiments of the present application will be clearly and completely described below. Obviously, the described embodiments are only a part of the embodiments of the present application, rather than all of them. All other embodiments obtained by those skilled in the art based on the embodiments in the present application without creative efforts shall fall within the protection scope of the present application. It should be understood that the specific embodiments described herein are only for illustration and explanation of the present application and are not intended to limit the present application.

Any specific numerical value (including the endpoints of numerical ranges) disclosed herein is not limited to the exact value of that numerical value, but should be understood to also cover values close to that exact value, for example, all possible numerical values within ±5% of that exact value. Furthermore, for the disclosed numerical ranges, one or more new numerical ranges can be obtained by arbitrarily combining values between the endpoint values of the range, between the endpoint values and specific point values within the range, and between various specific point values. These new numerical ranges should also be considered specifically disclosed herein.

The terminology used in this disclosure is for the purpose of describing particular exemplary embodiments only and is not intended to be limiting. As used herein, the singular forms "a," "an," and "the" are intended to include the plural forms as well, unless the context clearly indicates otherwise. The terms "comprises," "comprising," "contains," and "having" are inclusive, and thus specify the presence of stated features, elements, compositions, steps, integers, operations, and/or components, but do not preclude the presence or addition of one or more other features, integers, steps, operations, elements, components, and/or groups thereof. Although the open-ended term "comprising" should be understood as a non-limiting term used to describe and claim the various embodiments described in this disclosure, in some aspects, this term may instead be alternatively understood as more restrictive and limited terms, such as "consisting of" or "consisting essentially of." Thus, for any given embodiment that narrates compositions, materials, components, elements, features, integers, operations, and/or process steps, the present disclosure also specifically includes embodiments consisting of or consisting essentially of such described compositions, materials, components, elements, features, integers, operations, and/or process steps. In the case of "consisting of," alternative embodiments exclude any additional compositions, materials, components, elements, features, integers, operations, and/or process steps, while in the case of "consisting essentially of," any additional compositions, materials, components, elements, features, integers, operations, and/or process steps that substantially affect the basic and novel characteristics are excluded from such embodiments, but any compositions, materials, components, elements, features, integers, operations, and/or process steps that do not substantially affect the basic and novel characteristics may be included in this embodiment.

Any method steps, processes, and operations described in this disclosure should not be construed as necessarily requiring them to be performed in the specific order discussed or shown, unless a definite order of performance is explicitly determined. It is also to be understood that, unless otherwise stated, additional or alternative steps may be used.

In the present application, any unmentioned matters or items, in addition to the explicitly stated content, are directly applicable to those known in the art without any changes. Moreover, any embodiment described in this disclosure can be freely combined with one or more other embodiments described in this disclosure, and the resulting technical solutions or technical ideas are considered as part of the original disclosure or original record of the present application, and should not be regarded as new content not disclosed or foreseen by the present disclosure, unless those skilled in the art deem such combination to be clearly unreasonable.

Unless otherwise specified, the terms used herein have the same meaning as commonly understood by those skilled in the art. If a term is defined herein and its definition differs from common understanding in the art, the definition herein shall prevail.

Referring to FIGS. 1, 6, 9, 12, and 14, the present application provides an extension adapter 1 for mounting a target 2 on a target stand 3, wherein the extension adapter 1 comprises a connecting member 11 and a target mounting seat 12 interconnected with each other, wherein the connecting member 11 is configured to be detachably connected to the target stand 3, or be welded to the target stand 3, or be integrally formed with the target stand 3, and the target mounting seat 12 is configured to mount the target 2.

Figure 4:
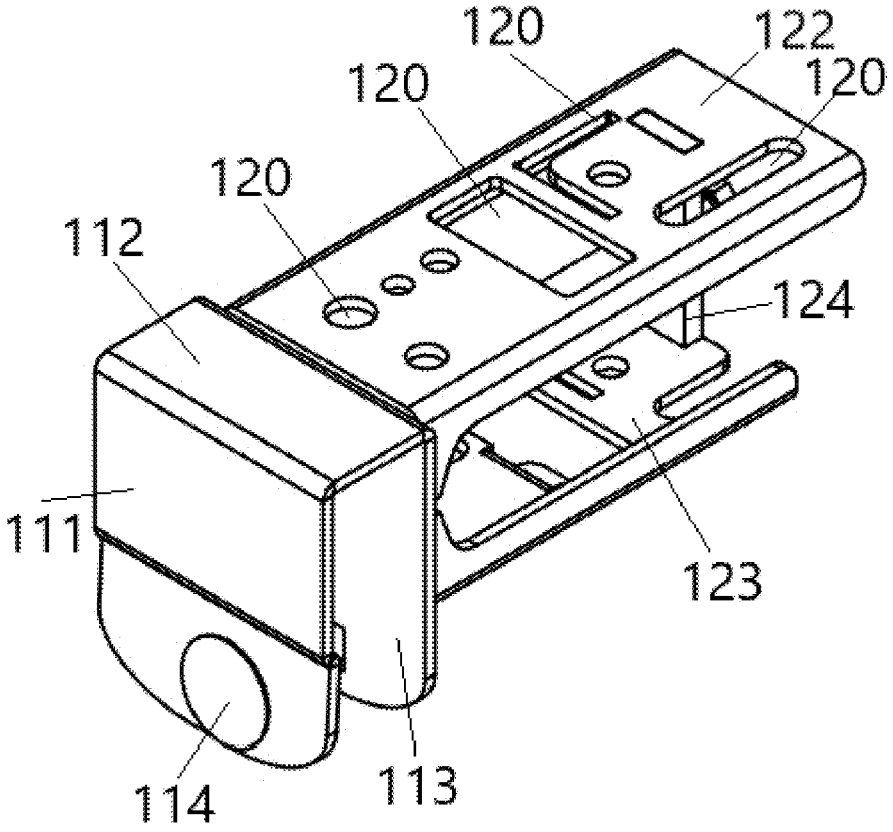
FIG. 4 is a schematic structural diagram of the extension adapter in FIG. 1.
Figure 5:
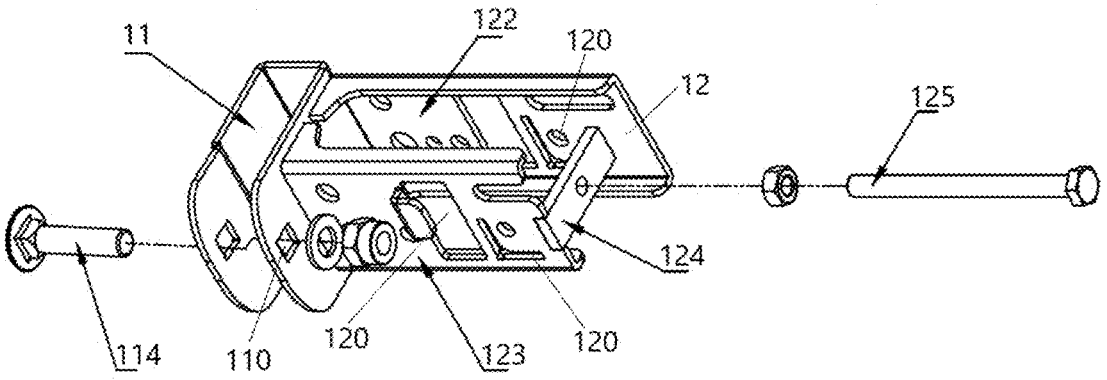
FIG. 5 is an exploded view of the extension adapter in FIG. 1.
Figure 17:
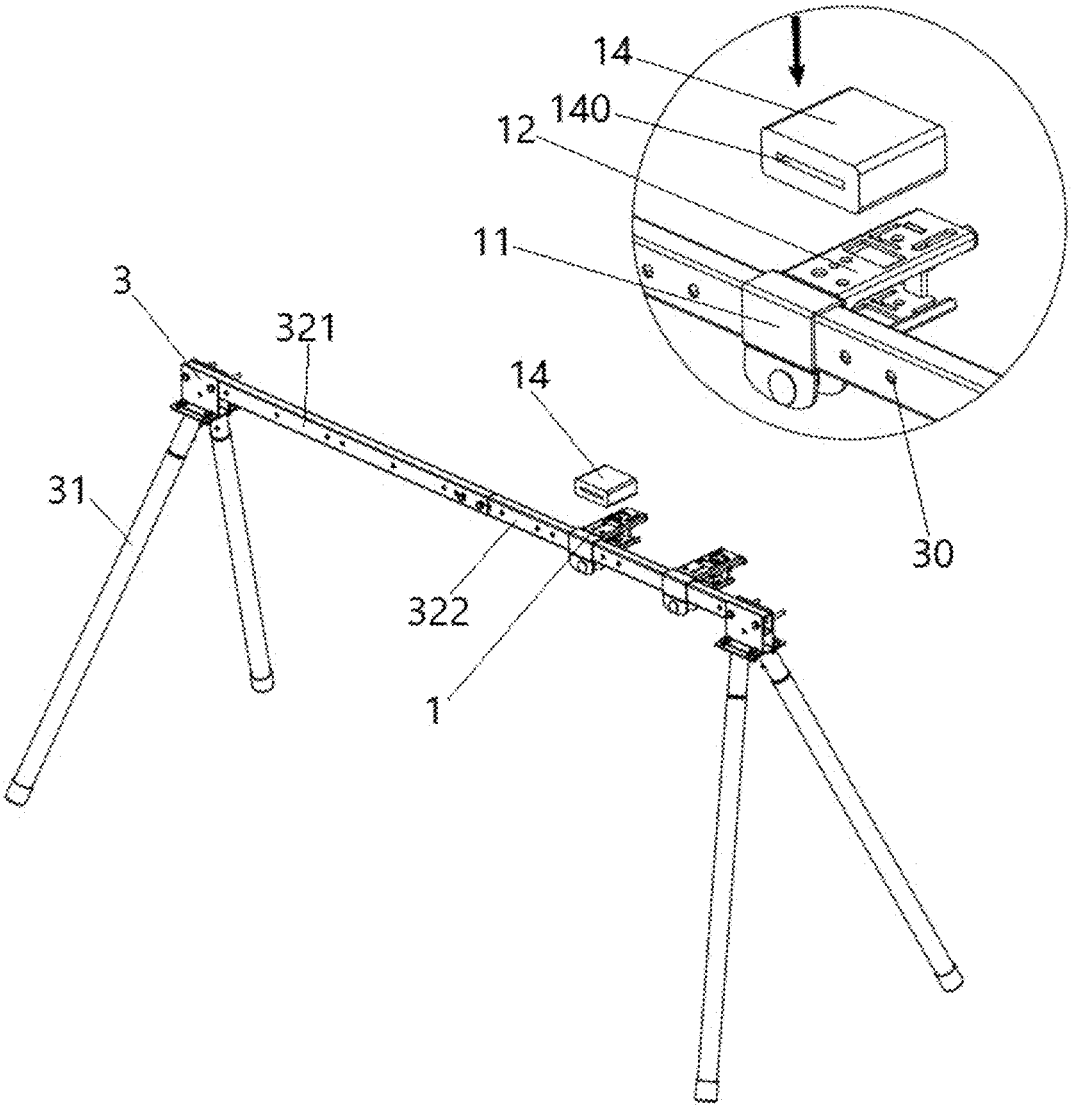
FIG. 17 is a schematic structural diagram of an extension adapter, a target, and a target stand according to a sixth embodiment of the present application.

Referring to FIGS. 4, 5, and 17, in some embodiments of the present application, the connecting member 11 and the target mounting seat 12 are integrally designed; in some embodiments of the present application, they can be formed by powder metallurgy, and in other embodiments, they can be formed by plastic 3D printing.

Referring to FIGS. 4, 5, and 17, in some embodiments of the present application, the connecting member 11 and the target mounting seat 12 are separately designed. In some embodiments of the present application, two connecting members 11 and target mounting seats 12 made of metal can be welded together; in other embodiments, the connecting member 11 and the target mounting seat 12, both made of polymer materials, can be bonded together using an organic adhesive.

In some embodiments of the present application, the connecting member 11 is provided with a magnetic attraction member, wherein the connecting member 11 is capable of being fixed on the target stand 3 via the magnetic attraction member.

In some embodiments of the present application, the target mounting seat 12 is provided with a magnetic attraction member, wherein the target mounting seat 12 is capable of fixing the target 2 thereto via the magnetic attraction member.

In some embodiments of the present application, the connecting member 11 is columnar and capable of being inserted into the target stand 3. It can be understood that in this situation, the target stand 3 needs to be provided with a hole for the columnar connecting member 11 to be inserted, and the hole in the target stand 3 can be horizontally or vertically oriented.

Figure 2:
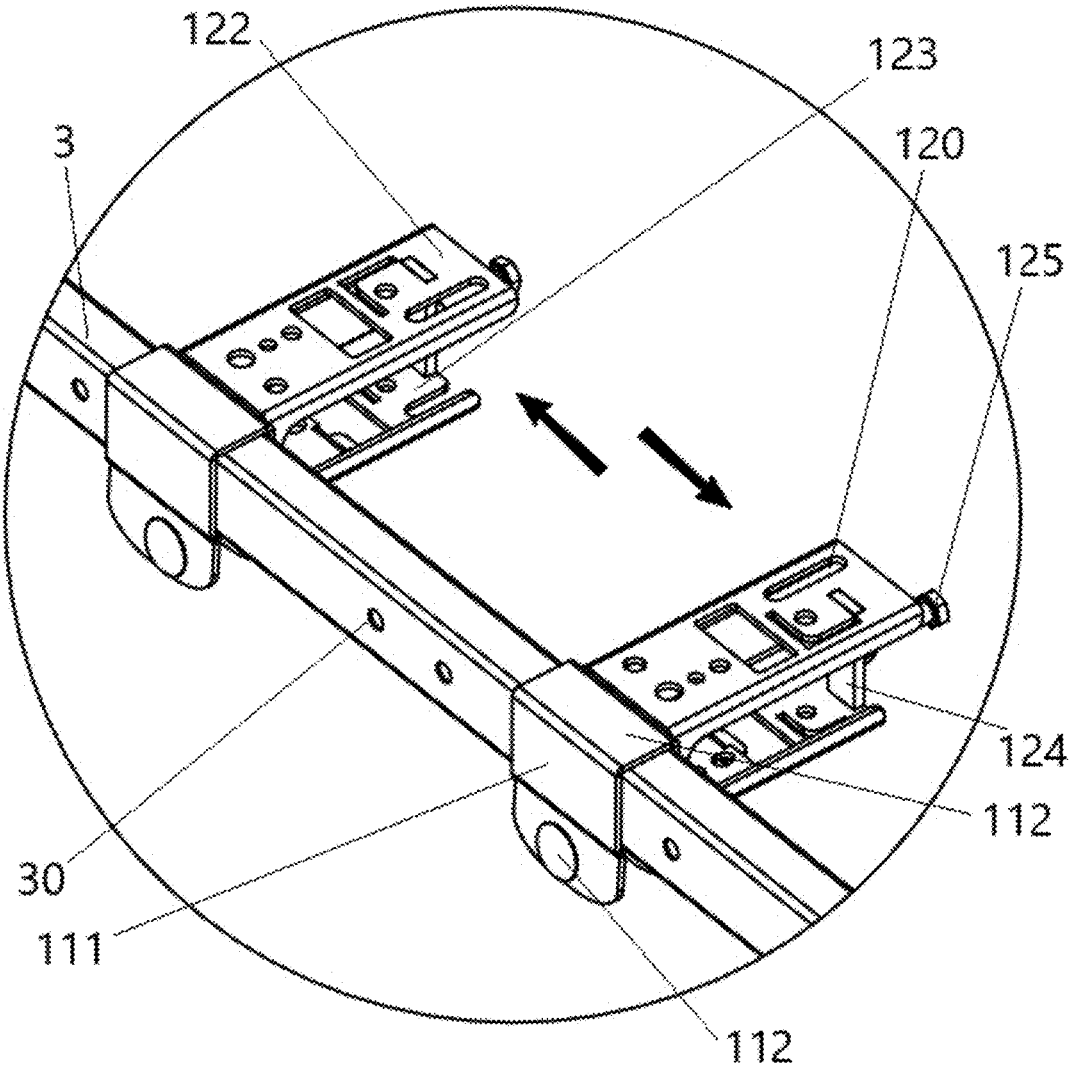
FIG. 2 is a partially enlarged schematic diagram of FIG. 1.
Figure 3:
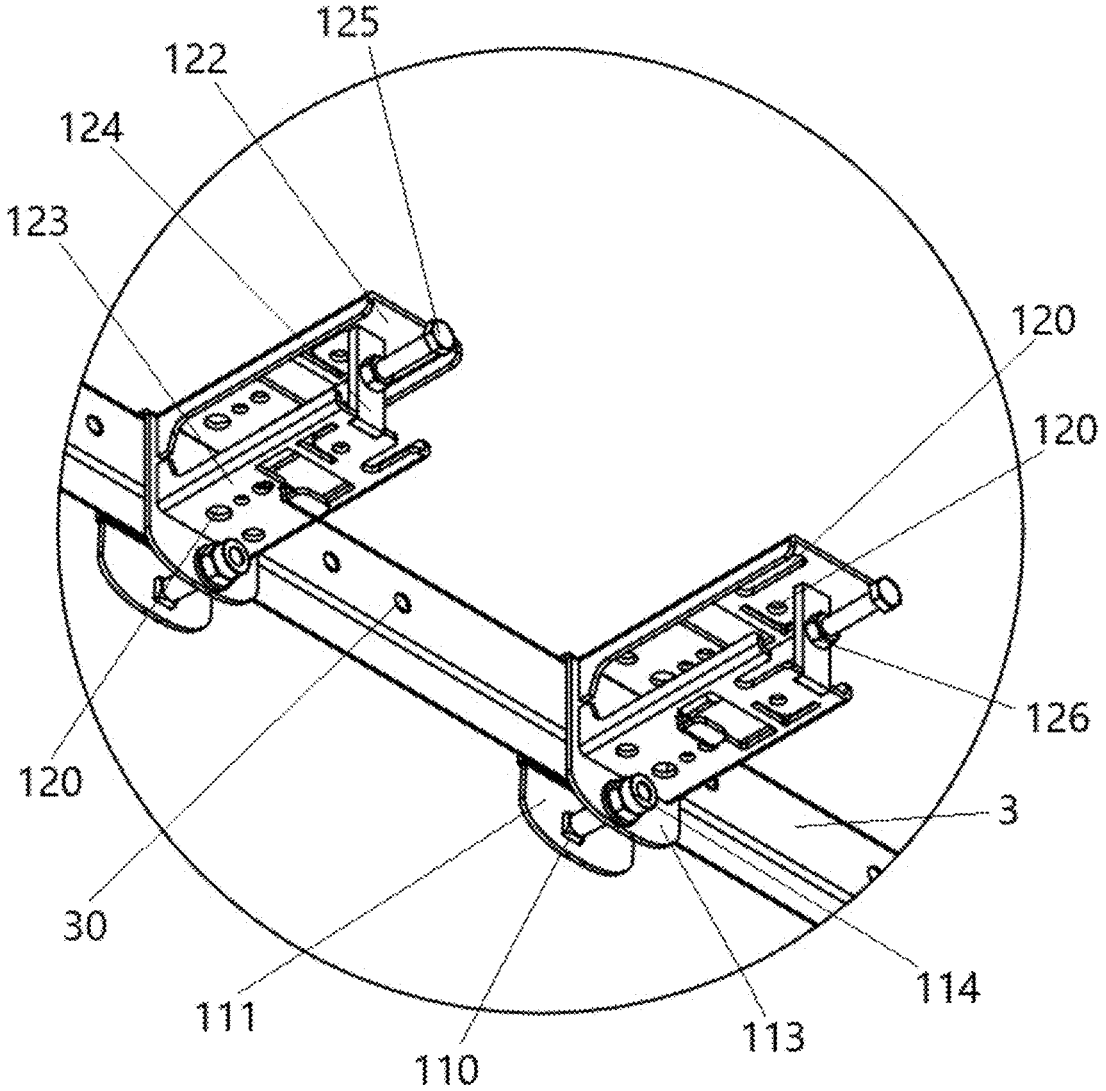
FIG. 3 is a schematic structural diagram of a local structure in FIG. 2 from another viewing angle.

In some embodiments of the present application, the connecting member 11 is semi-enclosedly sleeved on the target stand 3. Referring to FIGS. 1 to 3, in some embodiments of the present application, the target stand 3 is a square tube with a rectangular cross-section, and the connecting member 11 covers three planes of the square tube-shaped target stand 3, for example, it can cover the two planes facing and facing away from the user, and the upward-facing plane, while the downward-facing plane of the target stand 3 is not covered.

In some embodiments of the present application, the connecting member 11 is fully enclosedly sleeved on the target stand 3. Specifically, in some embodiments, the target stand 3 can be a square tube with a rectangular cross-section, or a round tube with a circular cross-section. Adaptively, the cross-sectional shape of the connecting member 11 matches the specific cross-sectional shape of the target stand 3; when in use, the connecting member 11 is sleeved from an end of the target stand 3 and then slid to the desired position.

Referring to FIGS. 2 to 5, in some embodiments of the present application, the connecting member 11 has a first support portion 111, a second support portion 112, and a third support portion 113 connected in sequence, wherein the first support portion 111 and the third support portion 113 are arranged parallel to each other, and the first support portion 111 and the third support portion 113 are each provided with a first through hole 110; the extension adapter 1 further comprises a first fastener 114, wherein the first fastener 114 sequentially passes through the first through hole 110 of the first support portion 111 and the third support portion 113, wherein the first fastener 114 can pass through or not pass through the target stand 3, so that the first support portion 111 and the third support portion 113 clamp the target stand 3, thereby fixing the extension adapter 1 to the target stand 3.

Referring to FIG. 5, in some embodiments of the present application, the first through hole 110 in the first support portion 111 and the first through hole 110 in the third support portion 113 are arranged directly opposite to each other, wherein the first fastener 114 is capable of sequentially passing through the first through hole 110 in the first support portion 111, the target stand 3, and the first through hole 110 in the third support portion 113. It can be understood that in this situation, the first fastener 114 passes through the target stand 3, and at this time, the target stand 3 needs to be provided with a corresponding through hole for the first fastener 114 to pass through.

Referring to FIG. 5, in some embodiments of the present application, the first through hole 110 in the first support portion 111 and the first through hole 110 in the third support portion 113 are arranged directly opposite to each other, wherein the first fastener 114 is capable of sequentially passing through the first through hole 110 in the first support portion 111 and the first through hole 110 in the third support portion 113. It can be understood that in this situation, the first fastener 114 does not pass through the target stand 3.

Referring to FIGS. 4 and 5, in some embodiments of the present application, at least one of the first support portion 111, the second support portion 112, and the third support portion 113 is plate-shaped. Specifically, the material of these three plate-shaped structures can be metal sheets or high-strength polymer sheets.

Referring to FIGS. 4 and 5, in some embodiments of the present application, the first support portion 111 and the third support portion 113 are flat plate-shaped. It can be understood that the connecting member 11 of this shape can be reliably mounted and engaged with a target stand 3 having a rectangular cross-section, providing good stability.

In some embodiments of the present application, the second support portion 112 is flat plate-shaped or curved plate-shaped. Wherein, referring to FIGS. 4 and 5, in some embodiments, the second support portion 112, like the first support portion 111 and the third support portion 113, is also flat plate-shaped. The connecting member 11 with this structure can be reliably mounted and engaged with a target stand 3 having a rectangular cross-section, providing good stability.

Referring to FIGS. 4 and 5, in some embodiments of the present application, the target mounting seat 12 is provided with a second through hole 120; wherein a bottom of the target 2 is capable of being inserted into or screwed into the second through hole 120, to be fixed on the extension adapter 1.

Referring to FIGS. 4, 5, 9, and 10, in some embodiments of the present application, the target mounting seat 12 is provided with a second through hole 120; the extension adapter 1 further comprises a second fastener 121, wherein the second fastener 121 passes through the second through hole 120, wherein the target 2 is capable of being fixed on the extension adapter 1 via the second fastener 121.

Referring to FIGS. 4 and 5, in some embodiments of the present application, the shape of the second through hole 120 is any one of circular, rectangular, L-shaped, triangular, elliptical, polygonal, and star-shaped.

Referring to FIGS. 4, 5, and 9 to 11, in some embodiments of the present application, the target mounting seat 12 comprises a first part 122 and a second part 123 arranged parallel to each other, wherein at least one of the first part 122 and the second part 123 is provided with the second through hole 120, to fix the target 2; wherein the target 2 is L-shaped, wherein a bottom of the L-shaped target 2 abuts against any one of the first part 122 and the second part 123, wherein the target 2 is fixed on the target mounting seat 12 by the second fastener 121. Wherein, the L-shaped target 2 has a target surface 21 provided with an aiming pattern and a base 22 connected to the target surface 21; the connection method between the target surface 21 and the base 22 can be welding, or elastic connection through a pin and a spring. When the target surface 21 is knocked down, it can be reset by the action of the spring for the next round of shooting.

Referring to FIGS. 4, 5, and 13 to 16, in some embodiments of the present application, the target mounting seat 12 comprises a first part 122 and a second part 123 arranged parallel to each other, wherein at least one of the first part 122 and the second part 123 is provided with the second through hole 120, to fix the target 2; wherein the target 2 is capable of sequentially passing through the first part 122 and the second part 123.

Referring to FIGS. 4, 5, and 13 to 16, in some embodiments of the present application, the second through holes 120 of the same shape in the first part 122 and the second part 123 are arranged directly opposite to each other, wherein the second fastener 121 is capable of sequentially passing through the second through hole 120 in the first part 122 of the target mounting seat 12, the bottom of the target 2, and the second through hole 120 in the second part 123.

It is worth noting that the specific forms of the aforementioned first fastener 114 and second fastener 121 can be a "pin+nut" combination, which can further include cushioning washers; alternatively, internal threads can be provided in the first through hole 110 and the second through hole 120, but this solution requires the components to have a certain thickness; in addition, a nut with internal threads can be welded to the outside of the through hole, which eliminates the need to increase the thickness of the component, and the fastening and locking effect can be achieved by screwing in a bolt or screw.

Referring to FIGS. 3 to 5, 7 and 8, 13, and 16, in some embodiments of the present application, the target mounting seat 12 further comprises a third part 124 and a third fastener 125, wherein the third part 124 is connected perpendicularly to at least one of the first part 122 and the second part 123, wherein the third part 124 is provided with a third through hole 126; wherein the third fastener 125 is capable of passing through the third through hole 126 to abut against the bottom of the target 2, so that the target 2 is fixed to the target mounting seat 12, or, the third fastener 125 is capable of sequentially passing through the third through hole 126 and the bottom of the target 2, so that the target 2 is fixed to the target mounting seat 12.

In some embodiments of the present application, an inner wall surface of the third through hole 126 is provided with a thread, wherein the third fastener 125 is provided with a thread.

In some embodiments of the present application, the third fastener 125 is a bolt, wherein at least one side of the second through hole 120, close to or away from a head of the bolt, is fixedly provided with a nut connecting therewith.

In some embodiments of the present application, at least one of the first part 122, the second part 123, and the third part 124 of the target mounting seat 12 is plate-shaped.

In some embodiments of the present application, a depth direction of the second through hole 120 is configured to be the same as a vertical direction; in this case, the target 2 can be directly inserted into the second through hole 120, which is convenient and quick.

In some embodiments of the present application, a depth direction of the second through hole 120 is configured to be the same as a horizontal direction; this situation is to adapt to some targets 2 having an L-shaped structure or a right-angle bent structure, wherein the target 2 is horizontally inserted into the second through hole 120, and the target surface 21 provided with an aiming pattern can be stood upright for the shooter to observe, aim, and shoot.

Figure 18:
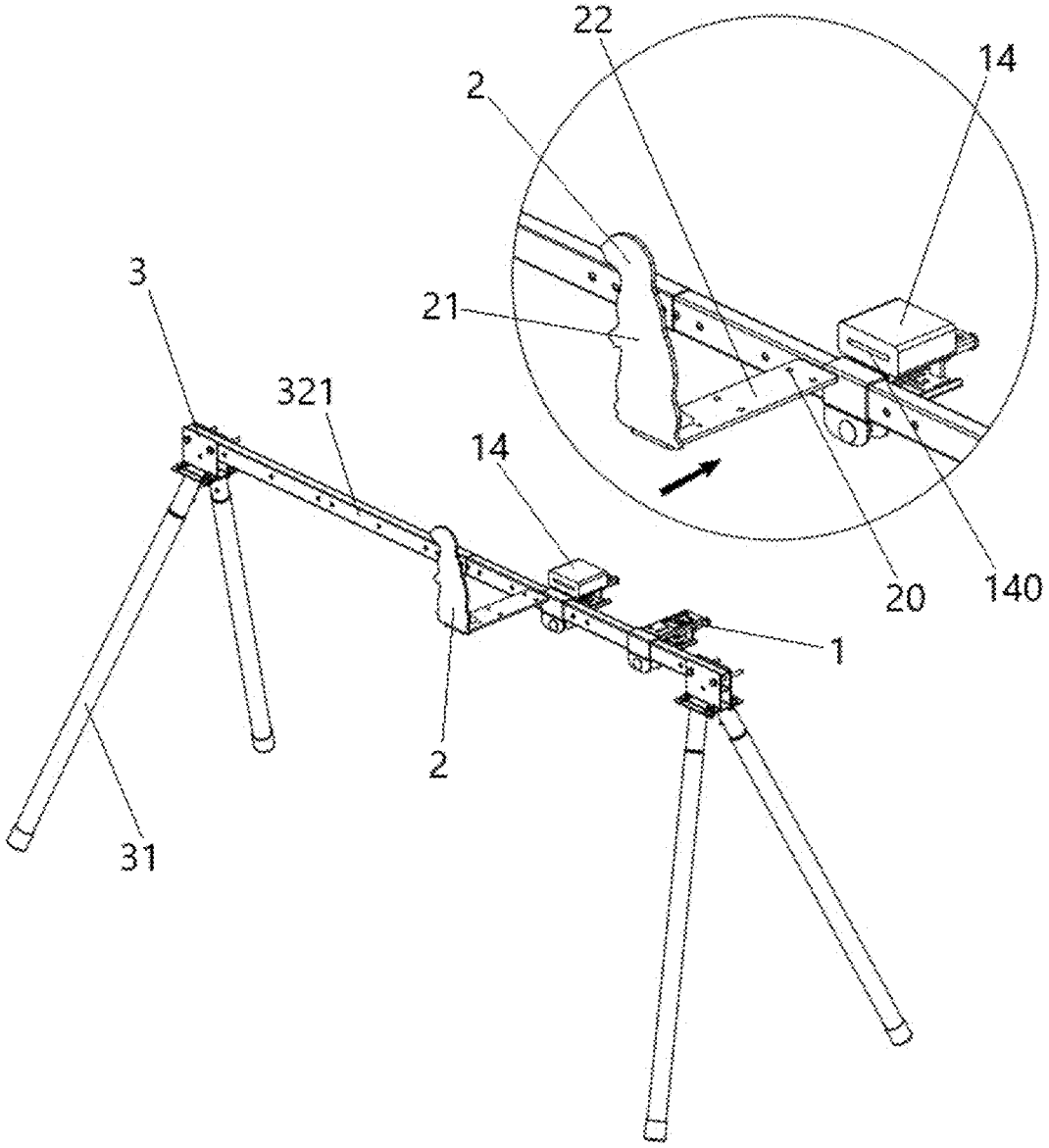
FIG. 18 is a partially enlarged schematic diagram of FIG. 17.
Figure 19:
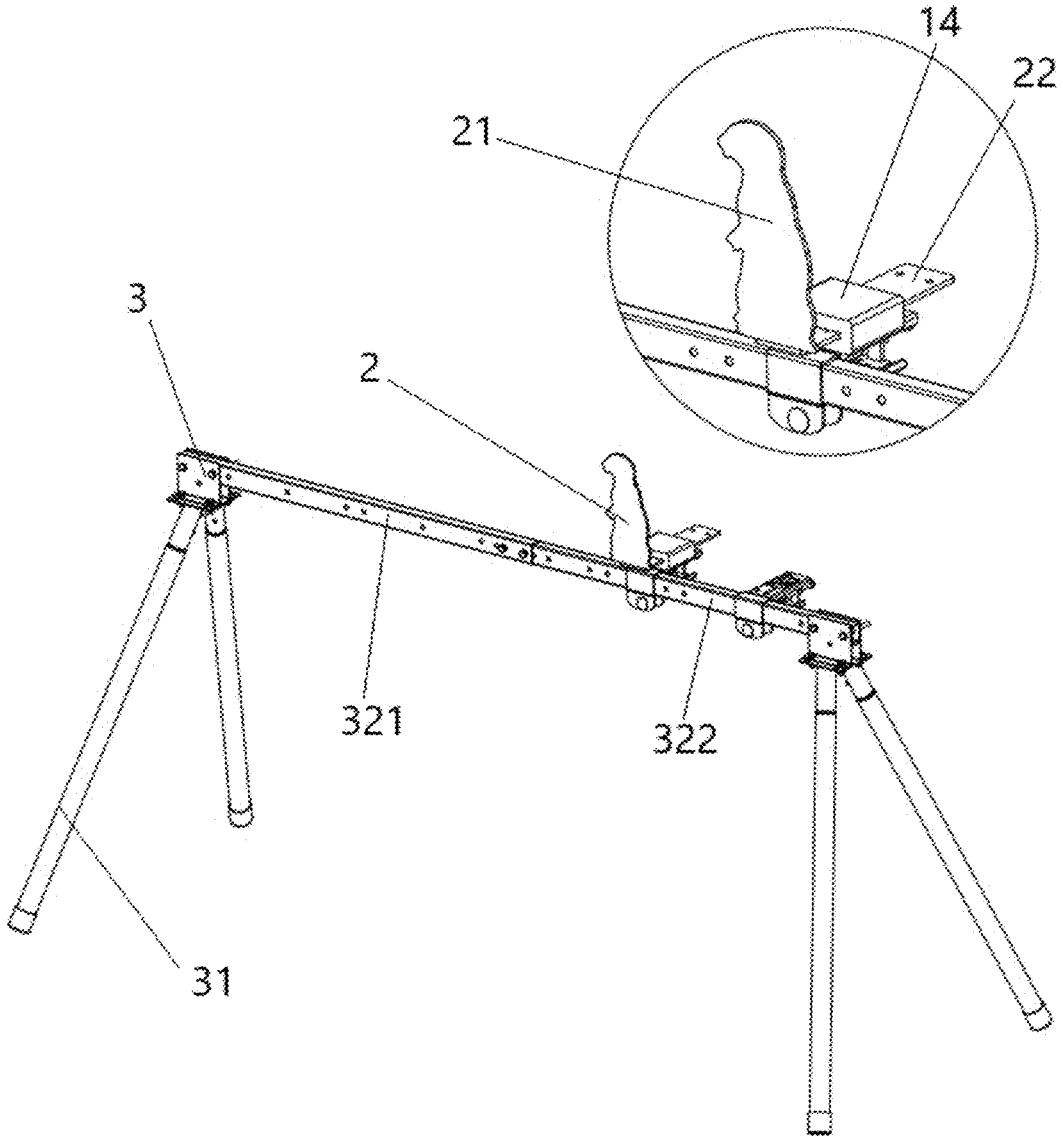
FIG. 19 is a schematic structural diagram of a local structure in FIG. 18 from another viewing angle.

Referring to FIGS. 17 to 19, in some embodiments of the present application, the extension adapter 1 further comprises a boss 14, wherein the boss 14 is provided on at least one of the first part 122 and the second part 123 of the target mounting seat 12, wherein the boss 14 is provided with an insertion hole 140, wherein an orientation of the insertion hole 140 is configured to be the same as the vertical direction, or the same as the horizontal direction, wherein the target 2 is capable of being inserted into the insertion hole 140.

Referring to FIGS. 17 to 19, in some embodiments of the present application, the base 22 of the target 2 is rectangular plate-shaped, and correspondingly, the shape of the insertion hole 140 on the boss 14 is flat; in other embodiments, the base 22 is rod-shaped, and at this time, the insertion hole 140 is a round hole.

Figure 6:
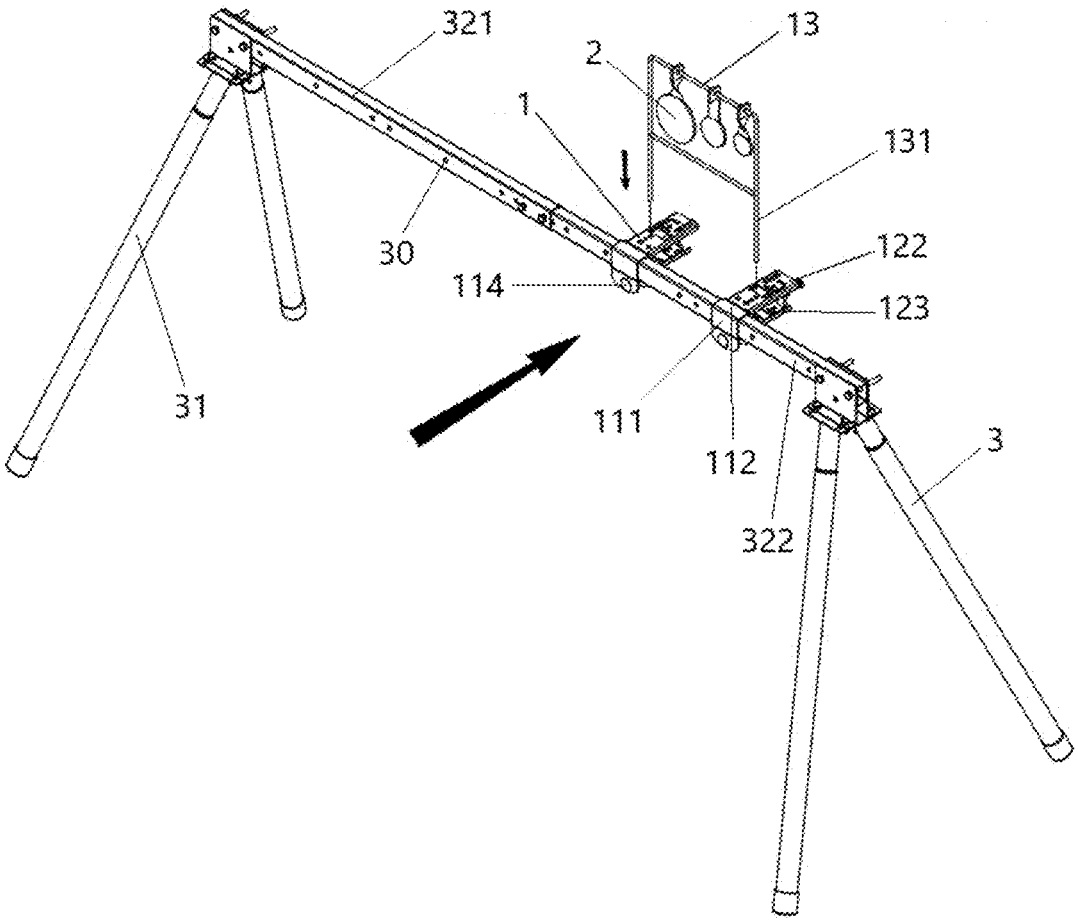
FIG. 6 is a schematic structural diagram of an extension adapter, a target, and a target stand according to a second embodiment of the present application.
Figure 7:
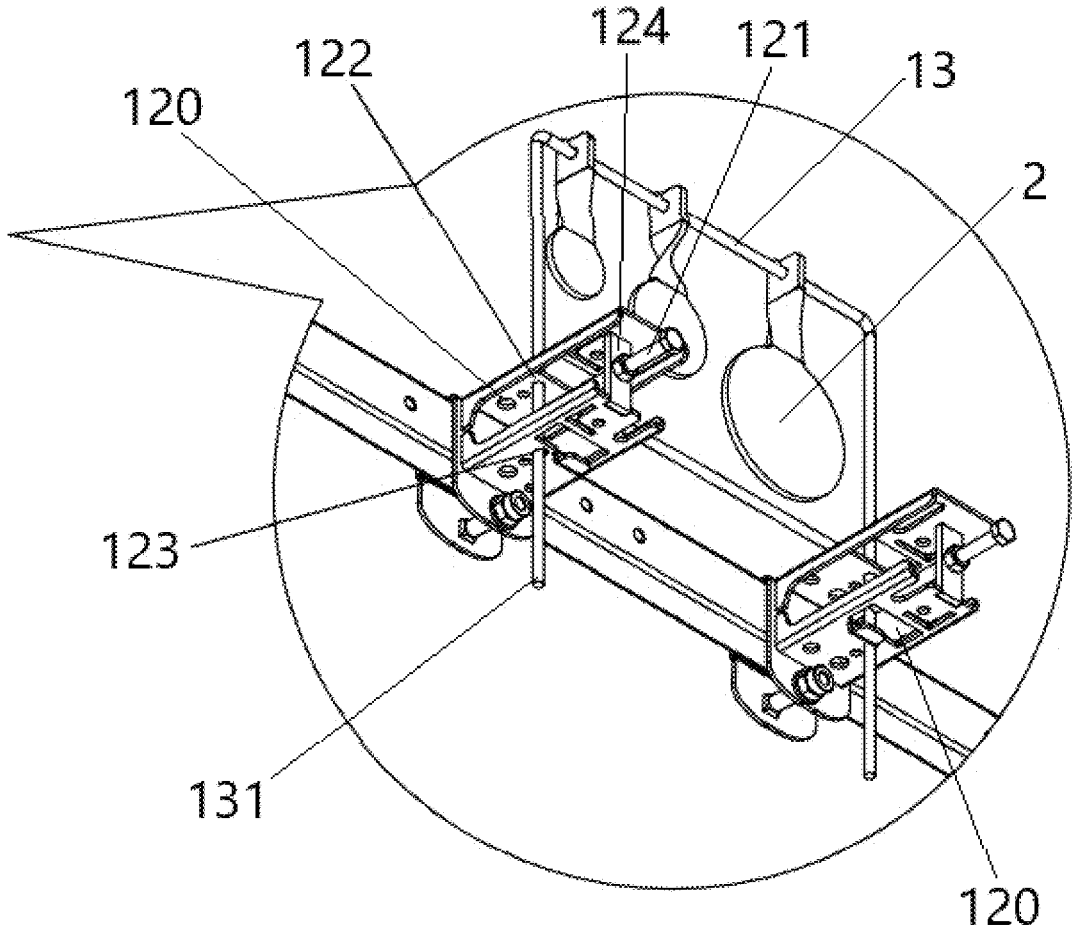
FIG. 7 is a partially enlarged schematic diagram of FIG. 6.
Figure 8:
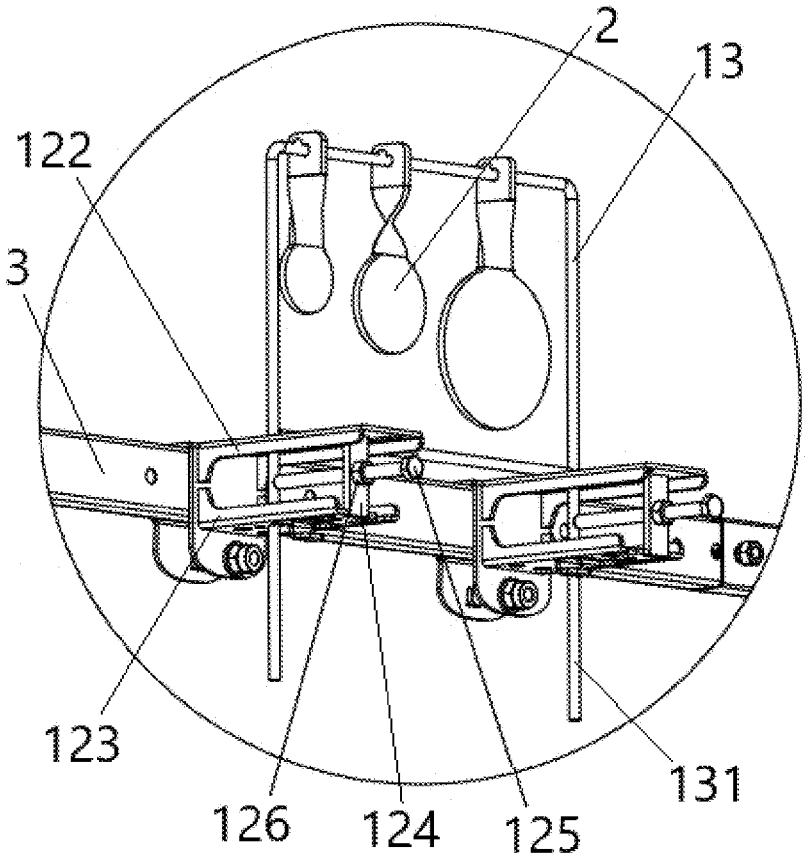
FIG. 8 is a schematic structural diagram of a local structure in FIG. 7 from another viewing angle.

Referring to FIGS. 6 to 8, in some embodiments of the present application, the extension adapter 1 further comprises a bracket 13, wherein the bracket 13 has at least two legs 131, wherein each leg 131 of the bracket 13 is inserted into a second through hole 120, wherein the bracket 13 is configured to suspend the target 2.

Through the description of the above solutions, it can be understood that: the extension adapter 1 according to the present application can stably fix the target 2 on the target stand 3; the extension adapter 1 according to the present application can be used individually, or multiple extension adapters 1 can be combined for use on the target stand 3 to adapt to different targets 2; the extension adapter 1 according to the present application is provided with holes of different shapes to adapt to different targets 2. The present application, through the above-described extension adapter 1, solves the problems of poor adaptability and mounting stability between targets 2 and target stands 3 having different sizes and specifications.

Referring to FIGS. 1, 6, 9, 12, 14, and 19, the present application provides a shooting assembly, wherein the shooting assembly comprises a target stand 3 and the aforementioned extension adapter 1, wherein the extension adapter 1 is detachably mounted on the target stand 3, or welded to the target stand 3, or integrally formed with the target stand 3.

Referring to FIGS. 1, 6, 9, 12, 14, and 19, in some embodiments of the present application, the shooting assembly further comprises a target 2, wherein the target 2 is inserted into the second through hole 120 of the extension adapter 1.

Referring to FIGS. 6 to 8, in some embodiments of the present application, the shooting assembly further comprises a target 2, wherein the target 2 is suspended or inserted in the bracket 13 of the extension adapter 1, wherein the number of the extension adapters 1 is at least two, wherein the bracket 13 has at least two legs 131, wherein each leg 131 is respectively inserted into a second through hole 120 of one of the extension adapters 1.

Figure 9:
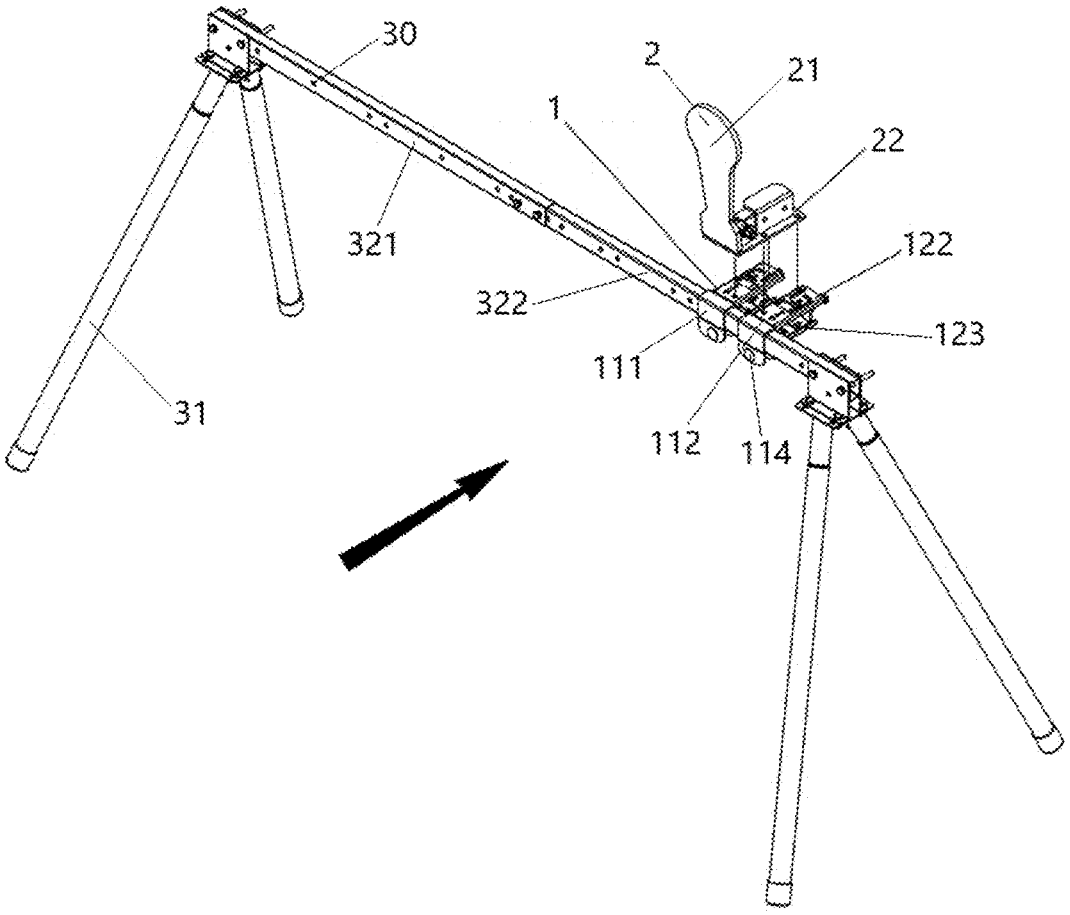
FIG. 9 is a schematic structural diagram of an extension adapter, a target, and a target stand according to a third embodiment of the present application.
Figure 10:
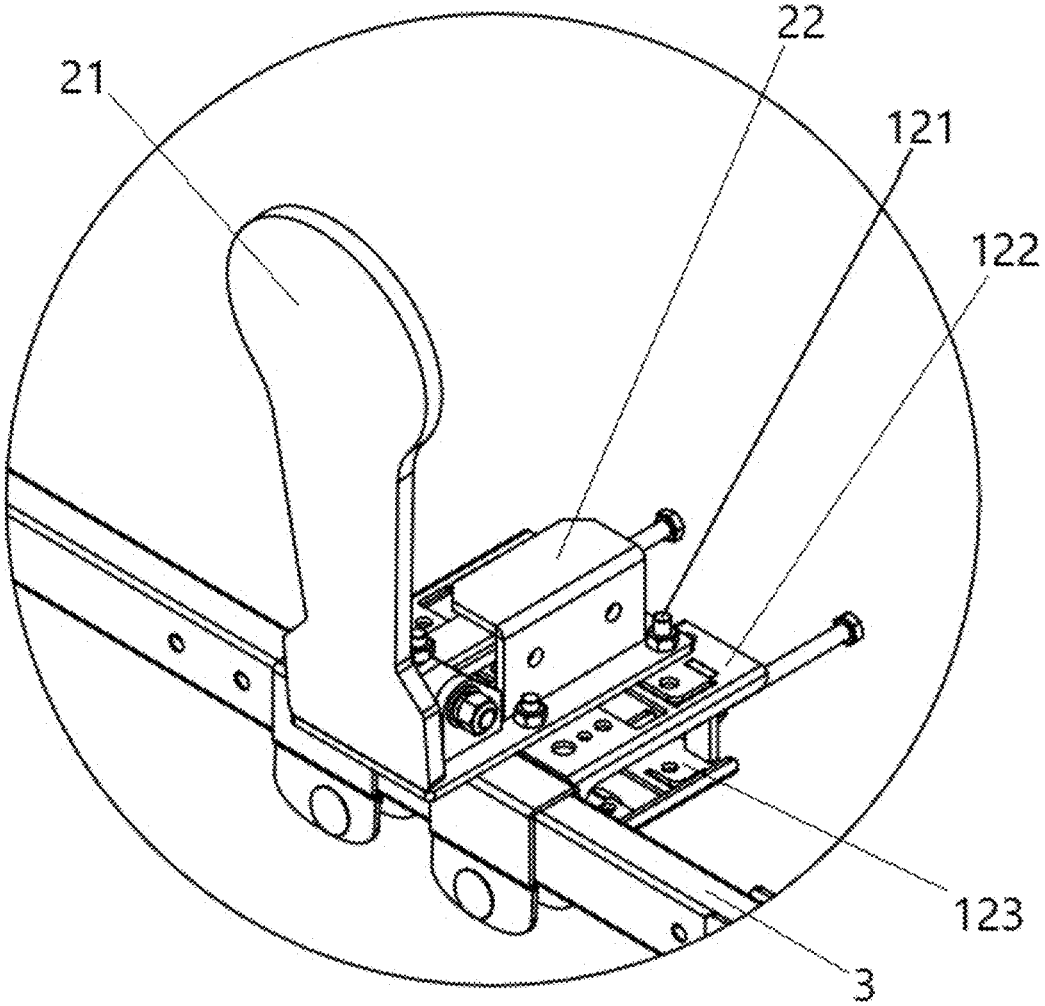
FIG. 10 is a partially enlarged schematic diagram of FIG. 9.
Figure 11:
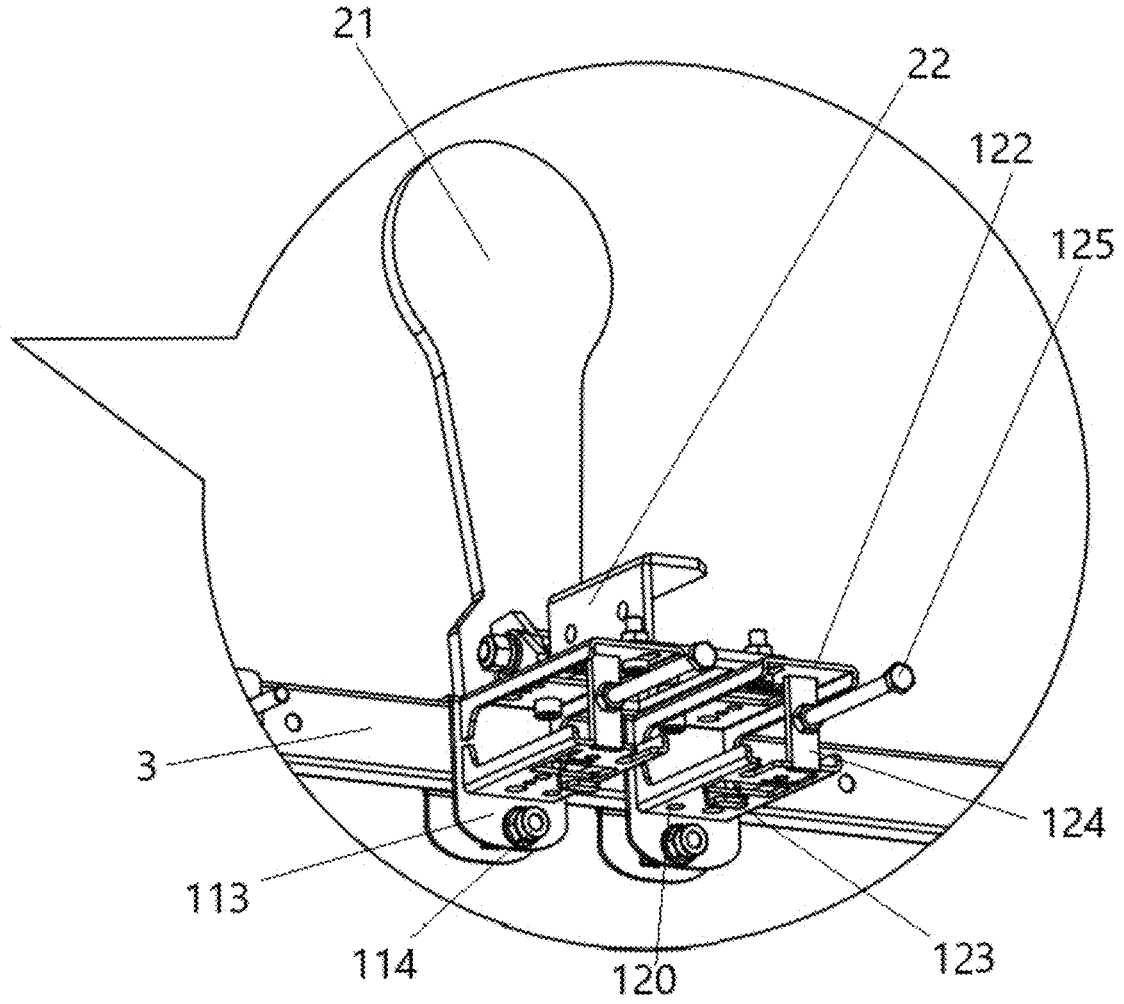
FIG. 11 is a schematic structural diagram of a local structure in FIG. 10 from another viewing angle.
Figure 12:
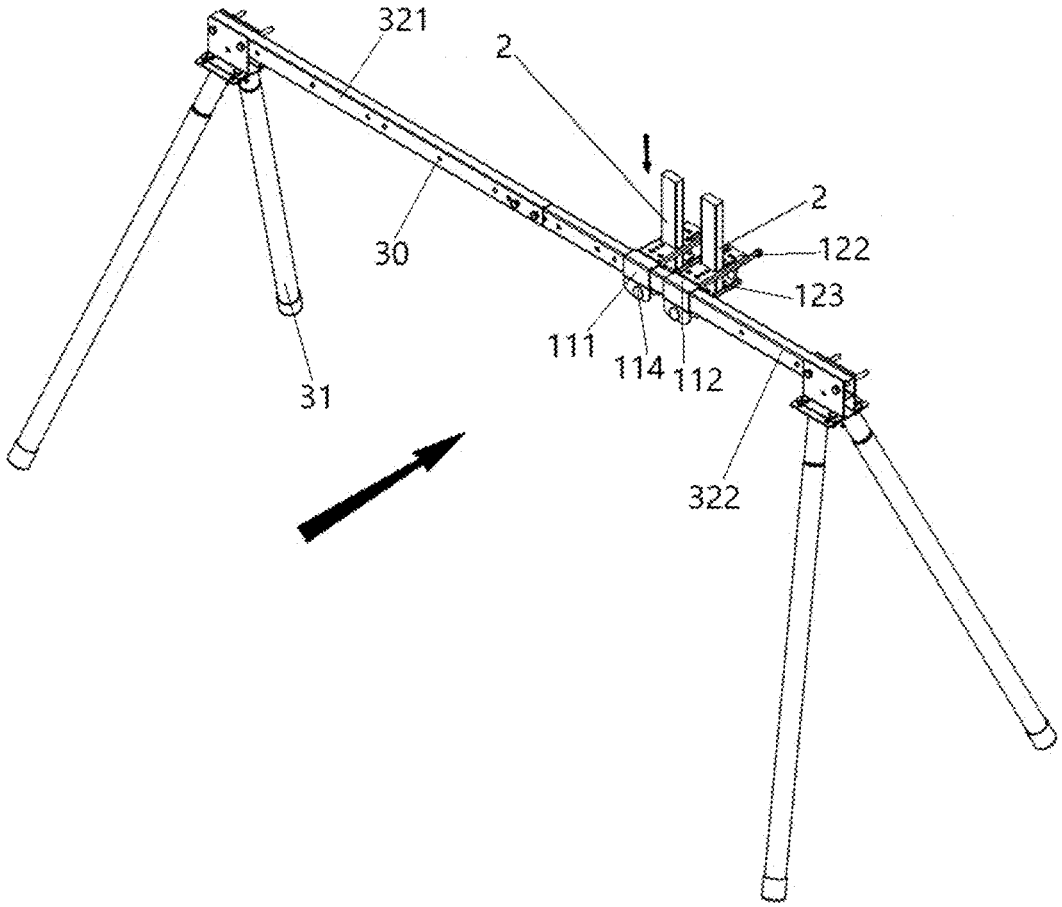
FIG. 12 is a schematic structural diagram of an extension adapter, a target, and a target stand according to a fourth embodiment of the present application.
Figure 13:
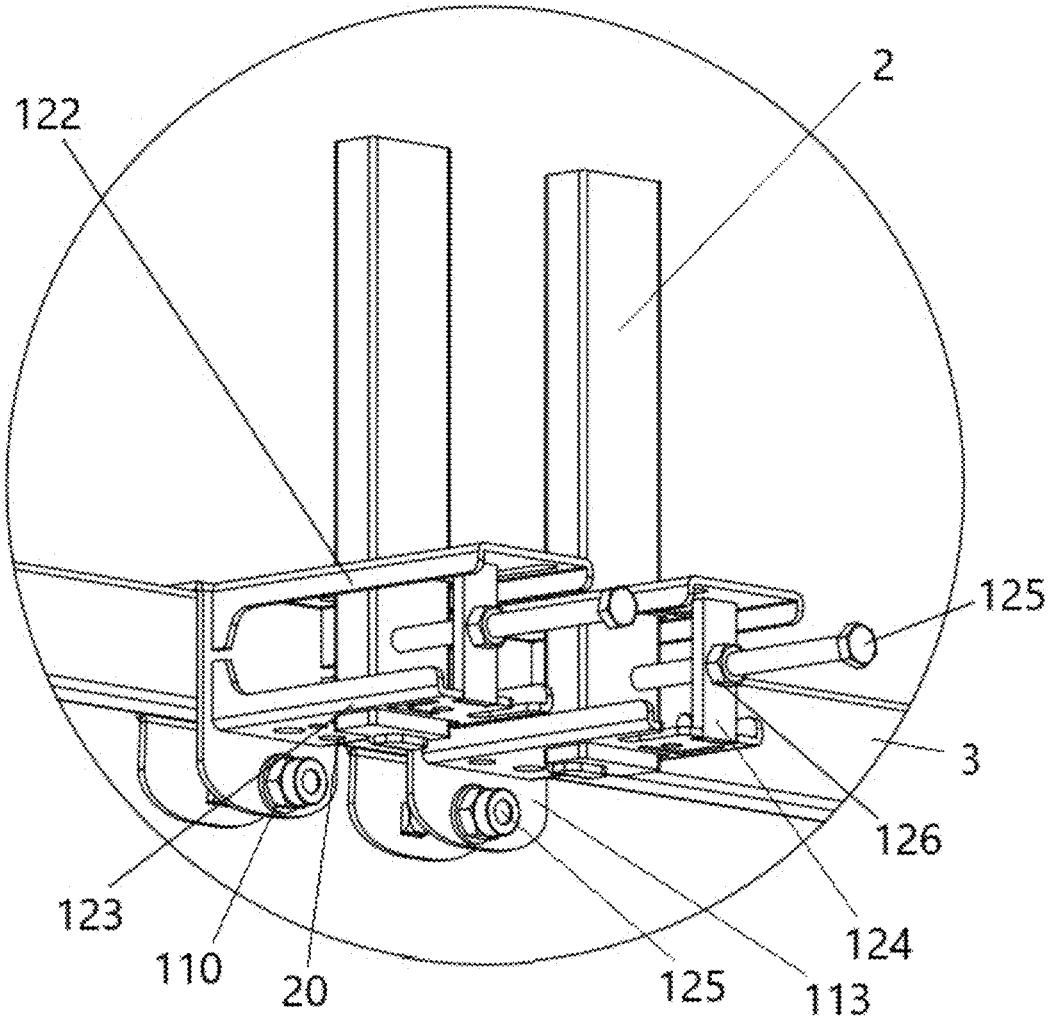
FIG. 13 is a partially enlarged schematic diagram of FIG. 12.
Figure 14:
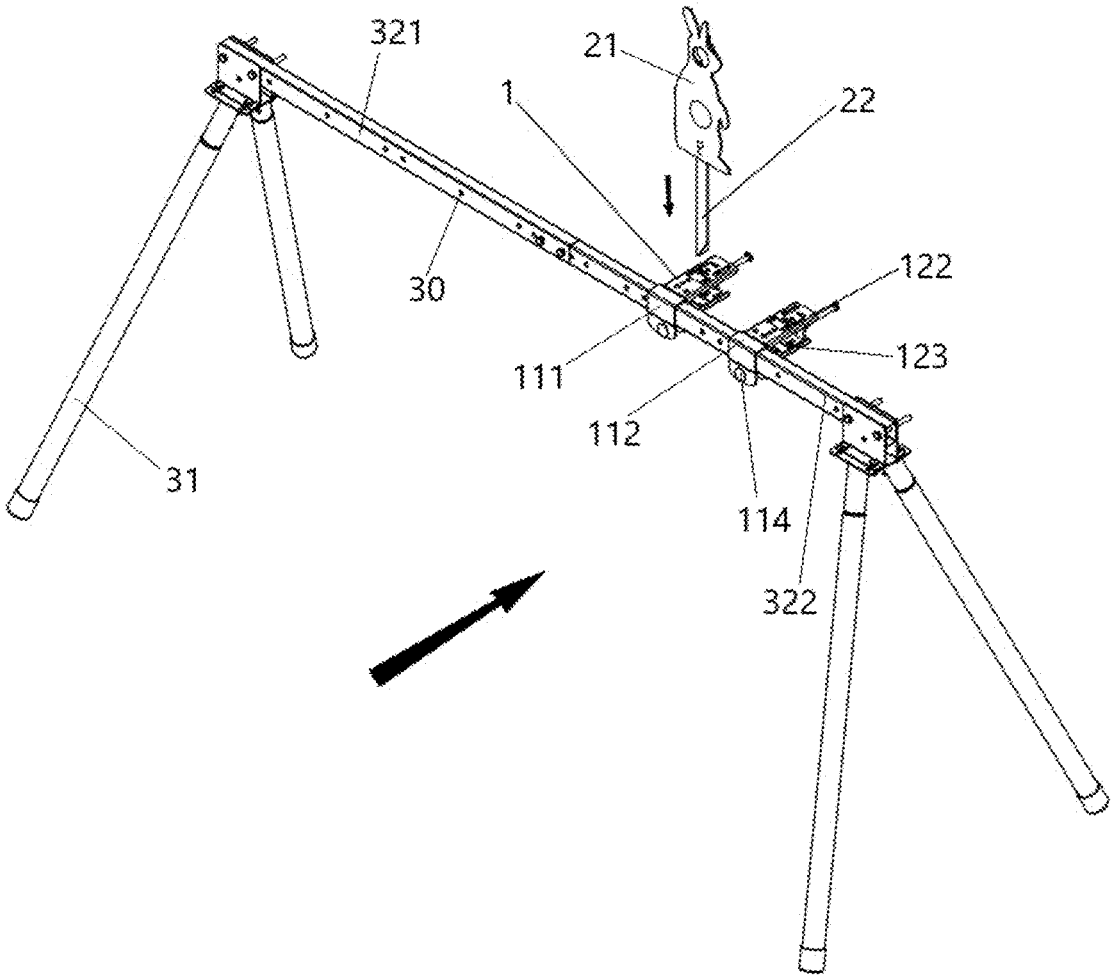
FIG. 14 is a schematic structural diagram of an extension adapter, a target, and a target stand according to a fifth embodiment of the present application.
Figure 15:
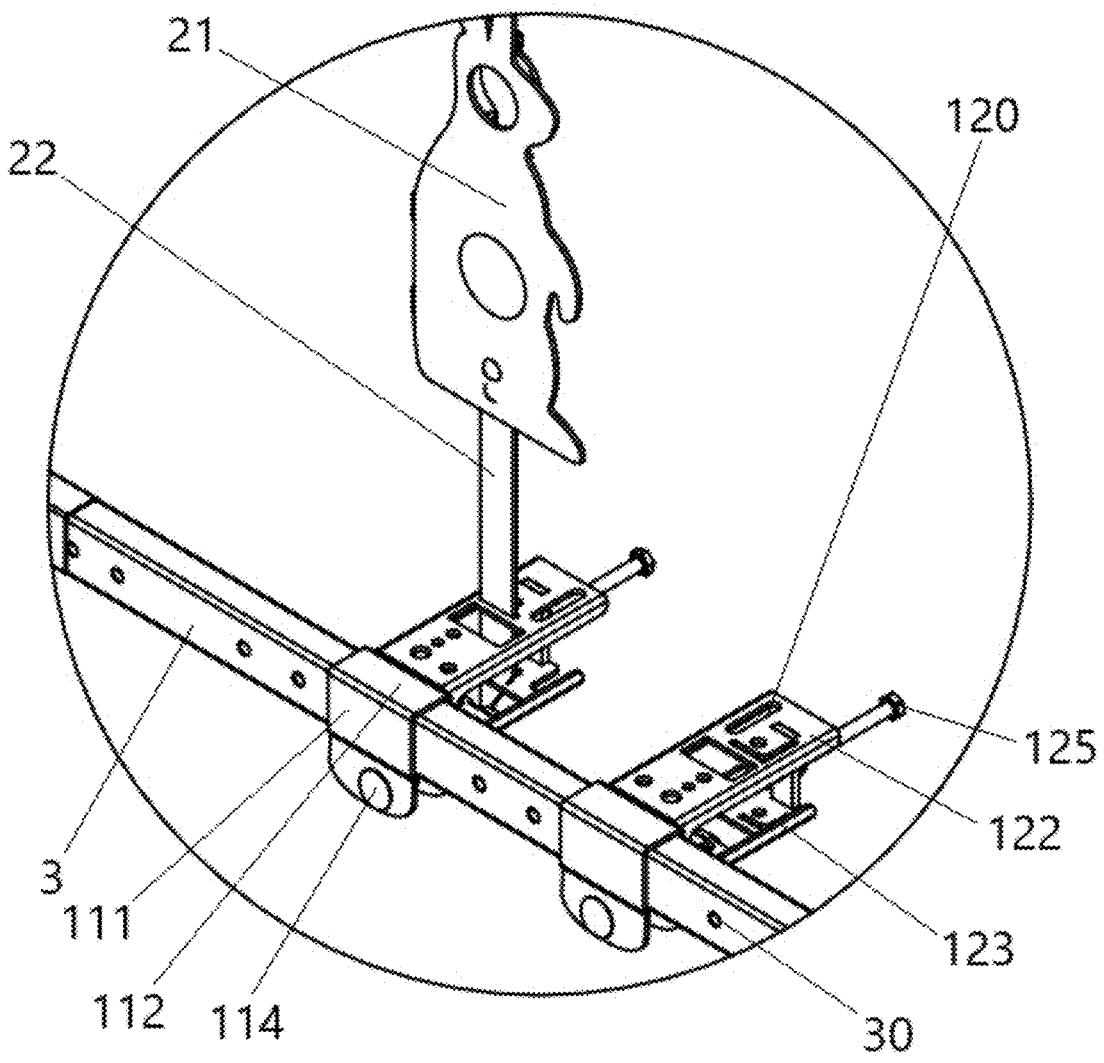
FIG. 15 is a partially enlarged schematic diagram of FIG. 14.

Referring to FIGS. 9 to 11, in some embodiments of the present application, the shooting assembly further comprises a target 2, wherein a bottom of the target 2 is provided with a fourth through hole 20, wherein the fourth through hole 20 and the second through hole 120 of the extension adapter 1 are arranged directly opposite to each other, wherein the second fastener 121 passes through the fourth through hole 20 and the second through hole 120, so that the target 2 and the extension adapter 1 are fixed to each other.

Figure 16:
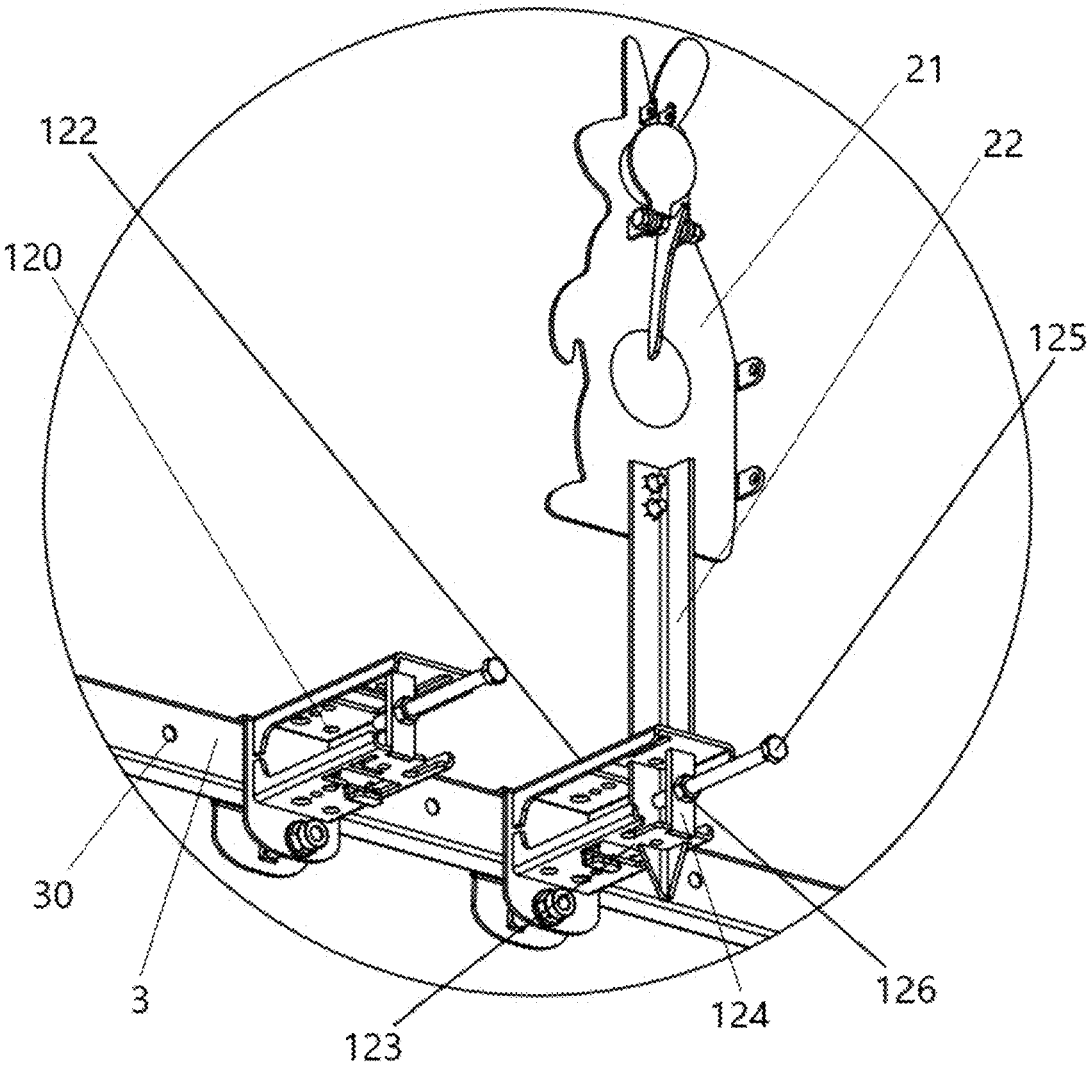
FIG. 16 is a schematic structural diagram of a local structure in FIG. 15 from another viewing angle.
Figure 20:
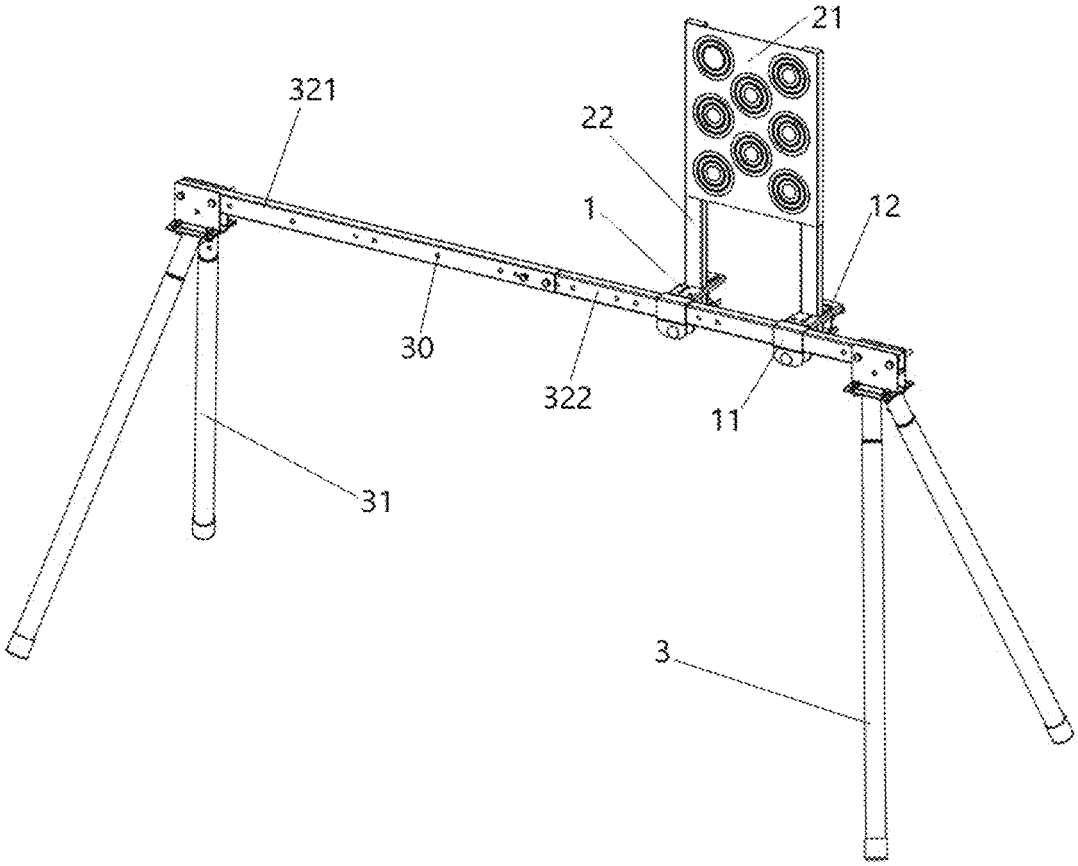
FIG. 20 is a schematic structural diagram of an extension adapter, a target, and a target stand according to a seventh embodiment of the present application.

Referring to FIGS. 1, 6, 9, 12, and 20, in some embodiments of the present application, two of the aforementioned extension adapters 1 are provided on a single target stand 3. Specifically, referring to FIG. 6, in some embodiments, two extension adapters 1 each fix one leg 131 of a bracket 13, and multiple targets 2 can be suspended or inserted in this bracket 13 simultaneously; in some embodiments, the target surface 21 provided with an aiming pattern can be directly suspended or inserted in the bracket 13. Referring again to FIG. 9, in this embodiment, at least two extension adapters 1 can be provided on one target stand 3, and each extension adapter 1 can respectively fix one target 2. Referring again to FIGS. 12 and 20, in these embodiments, at least two extension adapters 1 can be provided on one target stand 3, and each extension adapter 1 can respectively fix a wooden block. In some embodiments, the target surface 21 provided with an aiming pattern can be directly pasted or nailed onto the wooden block, and in other embodiments, a larger target surface 21 can be pasted or nailed onto two wooden blocks, with these two wooden blocks each fixed on an extension adapter 1. Referring to FIG. 20, in some embodiments, the spacing between adjacent wooden blocks can be adjusted by adjusting the spacing between the two extension adapters 1. At this time, the wooden blocks can be regarded as the base 21 of the target 2, and the target plate located between the two wooden blocks is equivalent to the target surface 21. The above solution can adapt to target surfaces 21 or targets 2 of different sizes, and the number of aiming patterns set on the target plate or target surface 21 can be more than one, which can be selected according to actual needs; the aforementioned "target surfaces 21 or targets 2 of different sizes" can specifically be any one or a combination of target boards and paper targets. Clearly, the shooting assembly according to the present application can adapt to target products of different specifications and design concepts, and can firmly fix target products of different specifications and design concepts on the target stand 3 for shooters to shoot. Referring to FIGS. 10, 16, and 18, in some embodiments of the present application, the target 2 comprises a target surface 21 and a base 22 detachably connected to each other, wherein the target surface 21 is configured for shooting, wherein the base 22 is connected to the extension adapter 1.

In some embodiments of the present application, the target surface 21 and the base 22 are fastened together by screws.

Referring to FIGS. 9 to 11, in some embodiments of the present application, the target surface 21 and the base 22 are connected by a pin shaft and a spring, wherein when the target surface 21 is knocked down, the spring can reset the target surface 21.

Referring to FIGS. 2 and 3, 6, 12, 14, and 16, in some embodiments of the present application, the target stand 3 is provided with a target stand through hole 30, wherein the first fastener 114 of the extension adapter 1 passes through the first through hole 110 of the extension adapter 1 and the target stand through hole 30, so that the extension adapter 1 is detachably mounted on the target stand 3.

Referring to FIGS. 2 and 3, 6, 12, 14, and 16, in some embodiments of the present application, the target stand 3 is provided with a target stand through hole 30, wherein the target 2 comprises a target surface 21 and a suspension chain detachably connected to each other, wherein the target surface 21 is configured for shooting, wherein the suspension chain is suspended on the target stand 3 via the target stand through hole 30.

Referring to FIGS. 1, 6, 9, 12, 14, and 17 to 19, in some embodiments of the present application, the target stand 3 comprises support legs 31 and a crossbar interconnected with each other, wherein the connecting member 11 of the extension adapter 1 is mounted on the crossbar. It can be understood that the shape of the crossbar can specifically be a square tube or a round tube. Correspondingly, the shape of the connecting member 11 sleeved on the crossbar is adaptively adjusted to match crossbars of different shapes.

Referring to FIGS. 1, 6, 9, 12, 14, and 17 to 19, in some embodiments of the present application, the target stand 3 comprises support legs 31 and a telescopic crossbar interconnected with each other, wherein the telescopic crossbar comprises a main body 321 and an extension rod 322 movably connected to each other, wherein the main body 321 is a hollow long rod, wherein the extension rod 322 can be accommodated in an inner cavity of the main body 321 and can also be pulled out from the inner cavity of the main body 321 to extend the length of the telescopic crossbar, wherein both the main body 321 and the extension rod 322 are provided with the target stand through hole 30.

In some embodiments of the present application, the aforementioned fasteners can specifically be bolt heads, and the bolt heads can be any one of hexagonal heads, round heads, square heads, countersunk heads, or flange heads.

Through the description of the above solutions, it can be understood that: the shooting assembly according to the present application can stably fix the target 2 on the target stand 3 via the extension adapter 1; the extension adapter 1 in the shooting assembly according to the present application can be used individually, or multiple extension adapters 1 can be combined for use on the target stand 3 to adapt to different targets 2; the extension adapter 1 in the shooting assembly according to the present application is provided with holes of different shapes to adapt to different targets 2; the present application solves the problems of poor adaptability and mounting stability between targets 2 and target stands 3 having different sizes and specifications.

The foregoing describes only specific embodiments of the present application, but the protection scope of the present application is not limited thereto. Any person skilled in the art can easily conceive changes or substitutions within the technical scope disclosed by the present application, and these changes or substitutions should be covered by the protection scope of the present application. Therefore, the protection scope of the present application should be subject to the protection scope of the claims. Furthermore, the description of specific examples in the specification has elucidated the principles and embodiments of the present application. The description of the above embodiments is only to help understand the method of the present application and its core idea, and the content of this specification should not be understood as a limitation on the present application.

What is claimed is:

1. An extension adapter for mounting a target on a target stand, comprising:

a connecting member configured for connecting to the target stand;

a target mounting seat interconnected with the connecting member and configured for mounting the target, wherein the target mounting seat comprises a first part and a second part arranged parallel to each other, wherein each of the first part and the second part has an insertion hole and a fastener hole; and wherein the target mounting seat is configured to allow the target to pass sequentially through the first part and the second part;

wherein the insertion hole is configured to receive a bottom of the target inserted into or screwed into the insertion hole to fix the target on the extension adapter, and wherein the fastener hole is configured to allow a fastener to pass through the fastener hole to fix the target on the extension adapter; and a fastener for the first and second part that passes through the fastener hole of one or both of the first part and the second part, wherein the target mounting seat further comprises a third part and a fastener for the third part, wherein the third part is connected perpendicularly to at least one of the first part and the second part, wherein the third part has a through hole; and wherein the fastener for the third part is configured to pass through the through hole of the third part to abut against the bottom of the target, so that the target is fixed to the target mounting seat; or the fastener for the third part is configured to pass sequentially through the through hole of the third part and the bottom of the target, so that the target is fixed to the target mounting seat.

2. The extension adapter according to claim 1, wherein the connecting member comprises a magnetic attraction member, wherein the connecting member is configured to be fixed on the target stand via the magnetic attraction member; or the target mounting seat comprises a magnetic attraction member, wherein the target mounting seat is configured to fix the target thereto via the magnetic attraction member.

3. The extension adapter according to claim 1, wherein the connecting member is columnar and configured to be inserted into the target stand.

4. The extension adapter according to claim 1, wherein the connecting member is sleeved on the target stand.

5. The extension adapter according to claim 4, wherein the connecting member has a first support portion, a second support portion, and a third support portion connected in sequence, wherein the first support portion and the third support portion are arranged parallel to each other, and the first support portion and the third support portion each have a through hole;

the extension adapter further comprises a fastener for connecting the first support portion and the third support portion, wherein the fastener for connecting the first support portion and the third support portion sequentially passes through the through hole of the first support portion and the through hole of the third support portion, wherein the fastener for connecting the first support portion and the third support portion is configured to pass through or not pass through the target stand, so that the first support portion and the third support portion clamp the target stand, thereby fixing the extension adapter to the target stand.

6. The extension adapter according to claim 5, wherein the through hole of the first support portion and the through hole of the third support portion are arranged directly opposite to each other, wherein the fastener for connecting the first support portion and the third support portion is configured to pass sequentially through the through hole of the first support portion, the target stand, and the through hole of the third support portion.

7. The extension adapter according to claim 1, wherein the fastener holes of the first part and the second part have the same shape and are arranged directly opposite to each other, wherein the fastener for the first and second part is configured to pass sequentially through the fastener hole of the first part, the bottom of the target, and the fastener hole of the second part.

8. The extension adapter according to claim 1, wherein an inner wall surface of the through hole of the third part has a thread, wherein the fastener for the third part comprises a thread;

or, the fastener for the third part is a bolt, wherein at least one side of the fastener hole, close to or away from a head of the bolt, is fixedly provided with a nut communicating therewith.

9. The extension adapter according to claim 1, wherein a depth direction of the insertion hole is configured to be the same as a vertical direction, or the same as a horizontal direction; or wherein the extension adapter further comprises a boss, wherein the boss is provided on at least one of the first part and the second part of the target mounting seat, wherein the boss has an insertion hole, wherein an orientation of the insertion hole of the boss is configured to be the same as the vertical direction, or the same as the horizontal direction, wherein the target is configured to be inserted into the insertion hole of the boss.

10. The extension adapter according to claim 1, wherein the extension adapter further comprises a bracket, wherein the bracket has at least two legs, wherein each leg of the bracket is inserted into the insertion hole, wherein the bracket is configured to suspend the target.

11. The extension adapter according to claim 1, wherein the connecting member is configured to be detachably connected to the target stand, or welded to the target stand, or integrally formed with the target stand.

12. A shooting assembly, comprising a target stand;

a target; and at least one extension adapter as claimed in claim 1.

13. The shooting assembly according to claim 12, wherein the target is inserted into insertion hole of the extension adapter; or wherein the extension adapter further comprises a bracket, and the target is suspended or inserted in the bracket, wherein the at least one extension adaptor includes at least two extension adaptors, wherein the bracket has at least two legs, wherein each leg is respectively inserted into the insertion hole of one of the at least two extension adapters;

or, a bottom of the target has a through hole, wherein the through hole of the bottom of the target and the fastener hole of the extension adapter are arranged directly opposite to each other, wherein the fastener for the first part and second part passes through the through hole of the bottom of the target and the fastener hole of the extension adapter, so that the target and the extension adapter are fixed to each other.

14. The shooting assembly according to claim 13, wherein the target comprises a target surface and a base detachably connected to each other, wherein the target surface is configured for shooting, wherein the base is connected to the extension adapter.

15. The shooting assembly according to claim 14, wherein the target surface and the base are connected by a pin shaft and a spring, wherein when the target surface is knocked down, the spring can reset the target surface.

16. The shooting assembly according to claim 12, wherein the target stand has a target stand through hole, wherein, the connecting member includes a first support portion, a second support portion, and a third support portion connected in sequence, wherein the first support portion and the third support portion are arranged parallel to each other, and the first support portion and the third support portion each have a through hole, wherein the extension adapter further comprises a further fastener passing through a through hole of the first support portion and a through hole of the third support portion of the connecting member of the extension adapter and the target stand through hole, so that the extension adapter is detachably mounted on the target stand; or the target comprises a target surface and a suspension chain detachably connected to each other, wherein the target surface is configured for shooting, wherein the suspension chain is suspended on the target stand via the target stand through hole.

17. The shooting assembly according to claim 16, wherein the target stand comprises support legs and a crossbar interconnected with each other, wherein the connecting member of the extension adapter is mounted on the crossbar.

18. The shooting assembly according to claim 17, wherein the crossbar is a telescopic crossbar, wherein the telescopic crossbar comprises a main body and an extension rod movably connected to each other, wherein the main body is a hollow long rod, wherein the extension rod can be accommodated in an inner cavity of the main body and can also be pulled out from the inner cavity of the main body to extend the length of the telescopic crossbar, wherein both the main body and the extension rod comprise the target stand through hole.

19. The shooting assembly according to claim 12, wherein the extension adapter is configured to be detachably mounted on the target stand, or welded to the target stand, or integrally formed with the target stand.

20. The extension adapter according to claim 1, wherein the insertion hole has a shape selected from the group consisting of circular, rectangular, L-shaped, triangular, elliptical, polygonal, and star-shaped.

* * * * *